US006615004B1

(12) United States Patent
Gila et al.

(10) Patent No.: US 6,615,004 B1
(45) Date of Patent: Sep. 2, 2003

(54) SUPPLYING MARKING FLUID IN AN IMAGING SYSTEM

(75) Inventors: Omer Gila, Cupertino, CA (US); David S. Vejtasa, Atherton, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/140,390

(22) Filed: May 6, 2002

(51) Int. Cl.[7] ..... G03G 15/10
(52) U.S. Cl. ..... 399/57
(58) Field of Search ..... 399/27, 53, 57, 399/61, 64, 237, 238; 347/7, 84, 85, 140; 73/305, 313, 314, 322.5, 293, 861, 861.04

(56) References Cited

U.S. PATENT DOCUMENTS

| | | | | |
|---|---|---|---|---|
| 3,558,861 A | * | 1/1971 | Collins | 73/313 |
| 4,008,612 A | * | 2/1977 | Nagaoka et al. | 399/57 X |
| 4,555,712 A | | 11/1985 | Arway et al. | |
| 4,827,280 A | | 5/1989 | Stamer et al. | |
| 5,003,352 A | * | 3/1991 | Duchesne et al. | 399/238 |
| 5,103,728 A | | 4/1992 | Barney | |
| 5,337,131 A | | 8/1994 | Sagiv et al. | |
| 5,396,273 A | | 3/1995 | Stamer | |
| 5,473,350 A | | 12/1995 | Mader et al. | |
| 5,655,194 A | | 8/1997 | Landa et al. | |
| 5,771,800 A | | 6/1998 | Inamine et al. | |
| 5,915,152 A | | 6/1999 | Meiri et al. | |
| 5,923,929 A | | 7/1999 | Ben Avraham et al. | |
| 6,067,906 A | | 5/2000 | Ryan et al. | |
| 6,108,513 A | | 8/2000 | Landa et al. | |
| 6,173,609 B1 | * | 1/2001 | Modlin et al. | 73/293 |
| 6,293,143 B1 | * | 9/2001 | Denton et al. | 73/293 |
| 6,337,959 B1 | * | 1/2002 | Kwak et al. | 399/57 |
| 6,350,021 B1 | | 2/2002 | Gray et al. | |
| 6,363,234 B2 | | 3/2002 | Landa et al. | |
| 6,430,380 B2 | * | 8/2002 | Kawakami | 399/57 |

OTHER PUBLICATIONS

U.S. Patent Publication No. 2002/0005869, Locher et al. (Jan. 17, 2002).

* cited by examiner

*Primary Examiner*—Sandra Brase

(57) ABSTRACT

Systems and methods of supplying marking fluid in an imaging system are described. In one aspect, height signals indicative of relative marking fluid levels in a marking fluid tank reservoir are generated. A measure of marking fluid flow rate is computed based upon multiple height signals generated during at least a portion of a startup period extending from a time when flow of marking fluid to the imaging assembly is insubstantial to a time when marking fluid in the marking fluid tank reservoir reaches a substantially steady-state level.

20 Claims, 6 Drawing Sheets

SUPPLYING MARKING FLUID IN AN IMAGING SYSTEM

TECHNICAL FIELD

This invention relates to imaging systems and methods.

BACKGROUND

Traditional methods of imaging (or printing) use various types of long-run print forms, such as gravure cylinders, offset plates and flexographic belts, which carry a recorded representation of a desired image (or "signature"). For example, lithographic offset printing methods typically use aluminum plates carrying imagewise signatures on rasterized ink-accepting and ink-repellant areas. A lithographic offset plate usually is imaged by applying an ultraviolet contact photography process to a sheet of silver film. In this process, exposed raster dot areas are etched from an initial ink-accepting state into a water-accepting state; unexposed raster dot areas remain in an ink-accepting state. Lithographic inks are hydrophobic, exhibit high viscosities and contain small amounts of solvent.

Other imaging methods, such as marking methods, do not require printing forms. For example, ink jet printing produces images by ballistically jetting a serial sequence of ink droplets from a distance onto a substrate (e.g., a paper sheet). Ink jet printing inks generally are volatile, exhibit low viscosity, and may be loaded into an ink jet printer in a liquid or a solid state. Some solid ink jet inks may be activated by heating. Other solid ink jet inks, such as inks containing rheological fluids, may be activated in other ways. A rheological fluid is a class of liquid whose viscosity may be controlled by an applied field: magneto-rheological fluids are responsive to magnetic fields, whereas electro-rheological fluids are responsive to electric fields. U.S. Pat. No. 6,221,138 has proposed an ink composition that is suitable for use in ink jet printing and includes a coloring agent and a carrier containing a magneto-rheological fluid with viscosity and flow properties that may be controlled by an applied magnetic field. U.S. Pat. No. 5,510,817 has proposed an ink jet ink composition that includes an electro-rheological fluid that enables the ejection of ink to be controlled by applying electric field that varies the viscosity of the ink and by creating a pressure difference in a venturi tube.

Electrostatic printing methods also do not require printing forms. In these methods, a discharge source typically deposits imagewise electrostatic charges onto a dielectric member (e.g., a plate or a drum) to generate an electrostatic latent image on the dielectric member. The latent image is developed into a visible image by depositing a charged developing material onto the surface of the dielectric member. Charged solids in the developing material adhere to image areas of the latent image. The developing material typically includes carrier granules having charged marking or toner solids that are electrostatically attracted from the carrier granules to the latent image areas to create a powder toner image on the dielectric member. In another electrostatic imaging method, U.S. Pat. No. 5,966,570 has proposed a technique in which an electrostatic latent image is formed directly in a layer of toner material as opposed to on a dielectric member. In this method, an image separator is electrically biased to selectively attract either image or non-image areas of the latent image formed in the toner layer.

In general, the rate of flow of marking fluid to the components of an imaging system should be tightly controlled. If the flow rate is too low, an insufficient amount of marking fluid will be deposited onto the dielectric member, resulting in poor image quality, overly thin ink layers, and possibly electrostatic breakdown in electrostatic imaging systems. If the flow rate is too high, on the other hand, excess marking fluid may spill from the marking fluid supply system, possibly damaging components of the imaging system, and may result in overly thick ink layers.

SUMMARY

The invention features a system for supplying marking fluid in an imaging system including an assembly of one or more imaging components. The system includes a marking fluid tank, a level sensor, and a controller. The marking fluid tank comprises a reservoir that is constructed and arranged to contain marking fluid. The level sensor is operable to generate height signals indicative of relative marking fluid levels in the marking fluid tank reservoir. The controller is coupled to the level sensor and is operable to compute a measure of marking fluid flow rate based upon multiple height signals generated during at least a portion of a startup period extending from a time when flow of marking fluid to the imaging assembly is insubstantial to a time when marking fluid in the marking fluid tank reservoir reaches a substantially steady-state level.

In another aspect, the invention features a method for supplying marking fluid in an imaging system. In accordance with this inventive method, a marking fluid tank comprising a reservoir constructed and arranged to contain marking fluid is provided. Height signals indicative of relative marking fluid levels in the marking fluid tank reservoir are generated. A measure of marking fluid flow rate is computed based upon multiple height signals generated during at least a portion of a startup period extending from a time when flow of marking fluid to the imaging assembly is insubstantial to a time when marking fluid in the marking fluid tank reservoir reaches a substantially steady-state level.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
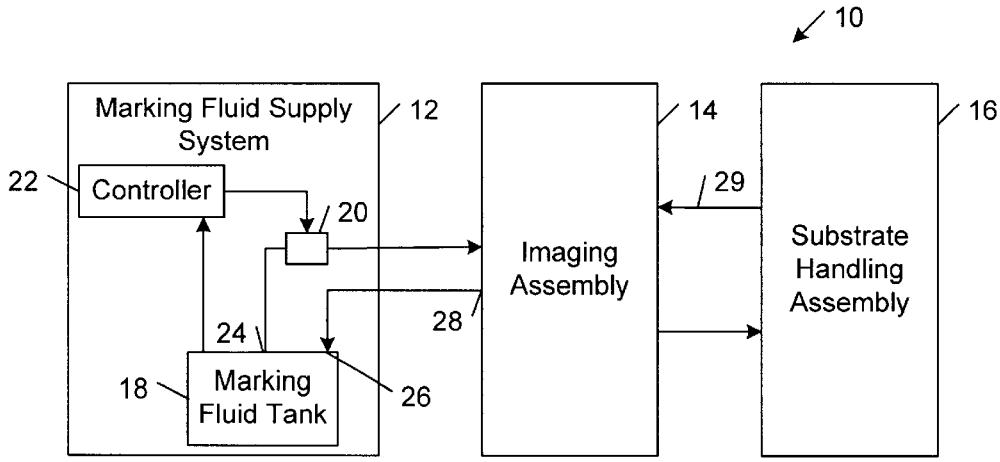
FIG. 1 is a block diagram of an imaging system that includes a marking fluid supply system, an electrostatic imaging assembly, and a substrate handling assembly.

Referring to FIG. 1, in one embodiment, an imaging system 10 includes a marking fluid supply system 12, an imaging assembly 14, and a substrate handling assembly 16. The marking fluid supply system 12 includes a marking fluid tank 18, a flow rate controller 20 (e.g., a valve adjustable by an associated stepper motor) that is connected between marking fluid tank 18 and electrostatic imaging assembly 14, and a controller 22. Marking fluid tank 18 includes a reservoir that is constructed and arranged to contain marking fluid, an outlet 24 that is connected to the flow rate controller 20, and a return inlet 26 that is connected to a return outlet 28 of the imaging assembly 14. In operation, marking fluid is pumped from marking fluid tank 18 to imaging assembly 14, where an image is formed on an image transfer member. The image then is developed by applying marking fluid to the image transfer member. The resulting marking fluid image is transferred to a substrate 29 (e.g., a paper web or sheet) that is supplied by substrate handling assembly 16.

Before each print job is initiated, the imaging assembly 14 is substantially free of marking fluid. During a startup period for a new print job, marking fluid is pumped through flow rate controller 20 to the imaging assembly 14. During this time, the marking fluid level in marking fluid tank 18 drops until excess marking fluid returns from imaging assembly 14, at which point a substantially steady-state marking fluid level is reached in marking fluid tank 18. The reduction in marking fluid level corresponds to the volume of marking fluid contained in the marking fluid transfer pipes and in one or more components of imaging assembly 14. As explained in detail below, controller 22 is operable to compute a marking fluid flow rate from marking fluid tank 18 to imaging assembly 14 based upon height signals received from a level sensor during at least a portion of the startup period.

Figure 2:
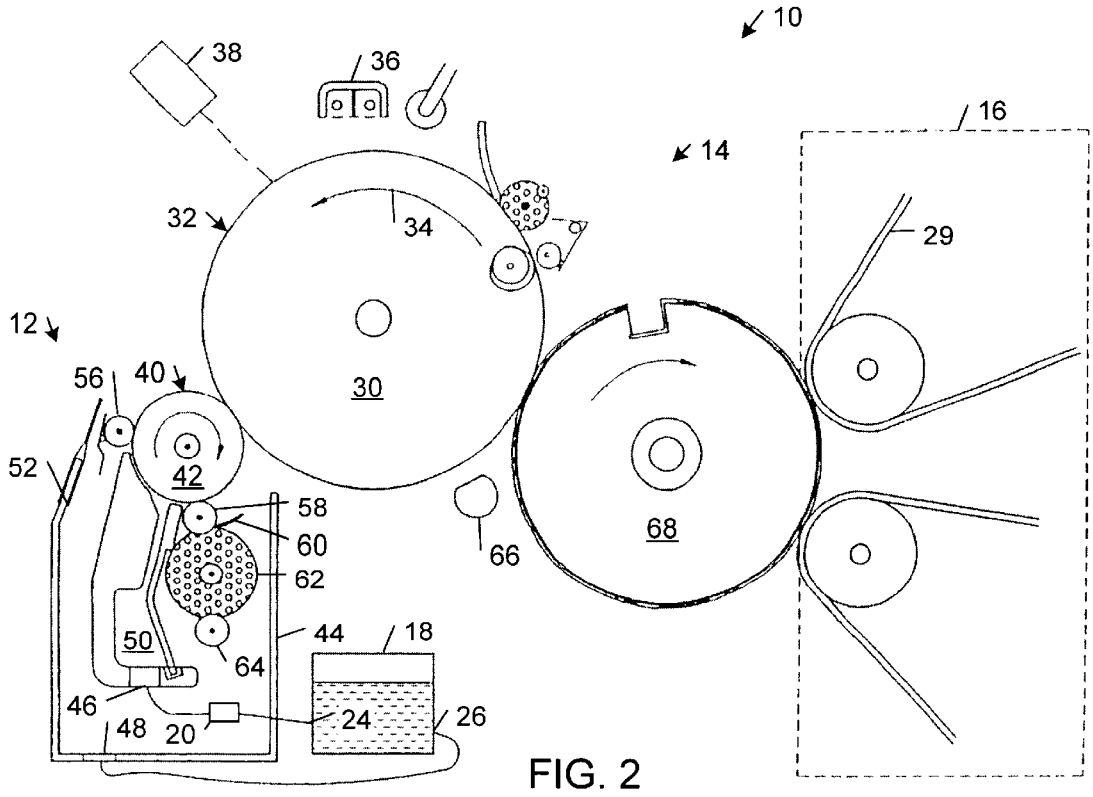
FIG. 2 is a diagrammatic side view of an electrostatic implementation of the imaging system of FIG. 1.

Referring to FIG. 2, in a monochromatic electrostatic imager implementation of imaging system 10, a drum 30 includes a cylindrical photoconductive surface 32. In operation, drum 30 rotates in the direction of arrow 34 and photoconductive surface 32 is charged by a charger 36 (e.g., a corotron, a scorotron, or a charge roller) to a predetermined uniform voltage level (e.g., on the order of 1,000 volts). Continued rotation of drum 30 brings the charged photoconductive surface 32 into image-receiving relationship with a light source 38 (e.g., a laser), which forms a desired latent image on the charged photoconductive surface 32 by selectively discharging a portion of the photoconductive surface.

Further rotation of drum 30 brings the photoconductive surface 32 bearing the electrostatic latent image into operative engagement with a surface 40 of a developer roller 42. Developer roller 42 rotates in an opposite direction as drum 30 so that there is substantially no relative motion between their respective surfaces at the points of contact. Developer roller 42 preferably is charged to a negative voltage of approximately 300–600 volts. The surface 40 of developer roller 42 is coated with a very thin layer of concentrated liquid toner with 20–50% charged toner particles. The concentrated liquid toner is supplied from a housing 44 having a toner inlet 46 and a toner outlet 48, which are coupled to marking fluid tank 18. Fresh liquid toner from marking fluid tank 18 is pumped via toner inlet 46 into an inlet chamber 50, and unused toner is returned from housing 44 to marking fluid tank 18 via toner outlet 48. The pressurized toner received via inlet 46 preferably is deposited on developer roller 42 by a depositing electrode 52, which forms a wall of inlet chamber 50. An opposite wall 54 preferably is formed of an electrically insulating material. Depositing electrode 52 preferably is charged to a negative voltage of about 900–2,000 volts. The large difference in voltage between electrode 52 and developer roller 42 causes toner particles to adhere to developer roller 42, whereas the electrically neutral carrier fluid generally is not affected by the voltage difference.

A squeegee roller 56 electrically and mechanically squeegees excess carrier liquid from surface 40 of developer roller 42 and a cleaning roller 58 removes residual toner from surface 40 of developer roller 42. The toner collected by cleaning roller 58 preferably is scraped off by a resilient cleaning blade 60, which is urged against the surface of roller 58. The scraped toner preferably is absorbed by a sponge roller 62, which rotates in the same direction as that of roller 58 so that their surfaces move in opposite directions at the region of contact. Toner particles and carrier liquid that are absorbed by sponge roller 62 is squeezed out by a relatively rigid squeezer roller 64.

When surface 40 of developer roller 42 engages photoconductive surface 32, the difference in voltages between developer roller 42 and photoconductive surface 32 causes toner particles to be selectively transferred to photoconductive surface 32 in the image area, thereby developing the desired latent image. In a binary image development (BID) implementation, the concentrated layer of liquid toner is completely transferred to photoconductive surface 32 during development. In a partial image development (PID) implementation, only a portion of the thickness of the concentrated toner particles is transferred to photoconductive surface 32. A discharge device 66 preferably floods the surface of drum 30 with light and thereby discharges the voltage remaining on photoconductive surface 32.

The developed latent image then may be transferred directly or indirectly to substrate 29. In the illustrated embodiment, the developed image is transferred to substrate 29 via an intermediate transfer member 68.

Additional details regarding the construction and operation of the electrostatic imaging system of FIG. 2 may be obtained from U.S. Pat. No. 6,108,513, which is incorporated herein by reference.

Figure 3:
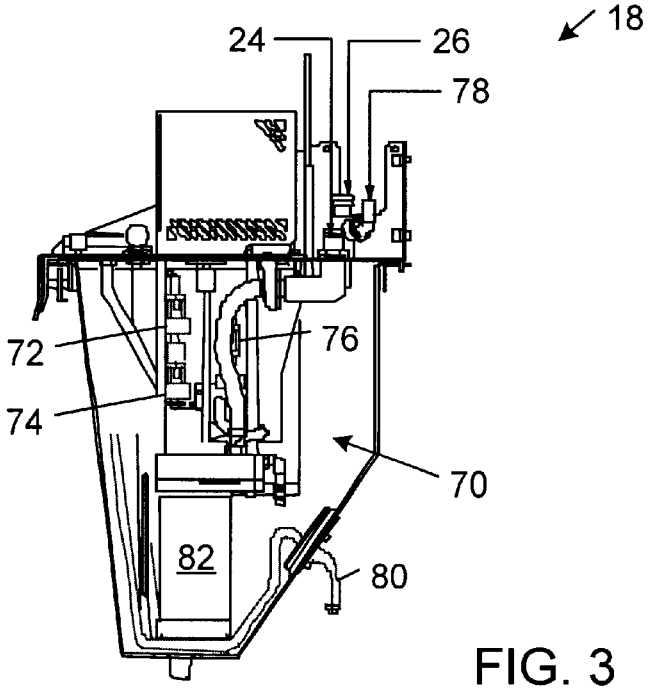
FIG. 3 is a diagrammatic side view of a marking fluid tank.

Referring to FIG. 3, in one embodiment, marking fluid tank 18 includes a reservoir 70, an overflow sensor 72, a low level sensor 74, and a working level sensor 76. Overflow sensor 72 and low level sensor 74 may be implemented in the form of any one of a wide variety of conventional level sensors, including a magnetic float that causes a reed switch magnetic proximity sensor to change state (open to close or vice versa). As explained in detail below, working level sensor 76 is operable to provide a real-time indication of the relative level of marking fluid contained in reservoir 70. The outputs of the sensors 72–76 are electrically connected to controller 22 (FIG. 1). An inlet 78 allows imaging oil to be added to reservoir 70. Marking fluid tank 18 also includes a cooling pipe 80 and a pump 82.

Figure 4:
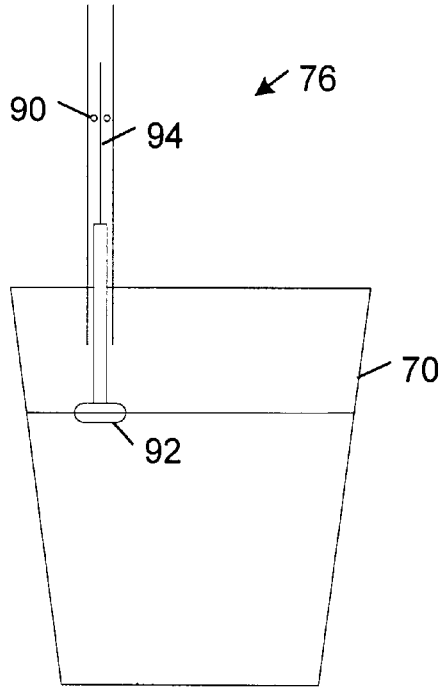
FIG. 4 is a diagrammatic side view of a marking fluid tank and a level sensor that includes an optical encoder and a float carrying an optical code strip.

Referring to FIG. 4, in some embodiments, working level sensor 76 may be implemented in the form of an optical encoder 90 and a float 92 carrying an optical code strip 94. In these embodiments, the float 92 tracks the level of marking fluid in reservoir 70 and the optical encoder 90 measures the displacement of the float 92 based upon diffraction patterns of light through gratings of optical code strip 94.

Figure 5A:
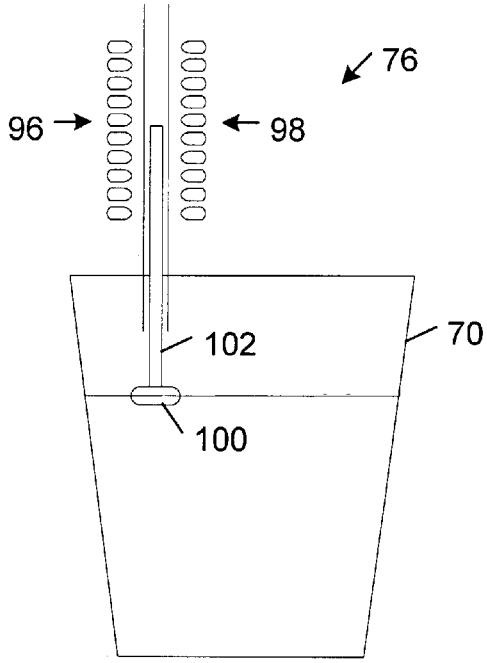
FIG. 5A is a diagrammatic side view of a marking fluid tank and a level sensor that includes multiple light emitters and multiple corresponding light detectors, and a float carrying a light-blocking member interposable between the light emitters and light detectors.
Figure 5B:
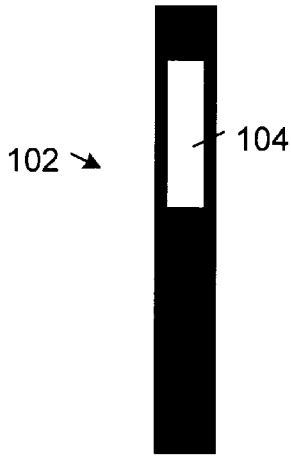
FIG. 5B is a diagrammatic side view of a light-blocking member with an aperture.

Referring to FIGS. 5A and 5B, in other embodiments, working level sensor 76 may include one or more light emitters 96 (e.g., light emitting diodes) and one or more corresponding light detectors 98 (e.g., photodiodes), and a float 100 carrying a light-blocking member 100 that is interposable between one or more light emitters 96 and corresponding light detectors 98. Light-blocking member 102 may be formed from any suitable material that blocks the transmission of light from light emitters 96 to light detectors 98. In these embodiments, the float 100 tracks the level of marking fluid in reservoir 70 and the set of light emitters 96 and light detectors 98 measure the displacement of the float 100 based upon which of the pairs of light emitters and light detectors are blocked by light-blocking member 100. As shown in FIG. 8B, in some of these embodiments, the light-blocking member 102 may include an aperture 104, which may increase the resolution and accuracy with which the displacement of float 100 may be measured.

Figure 6:
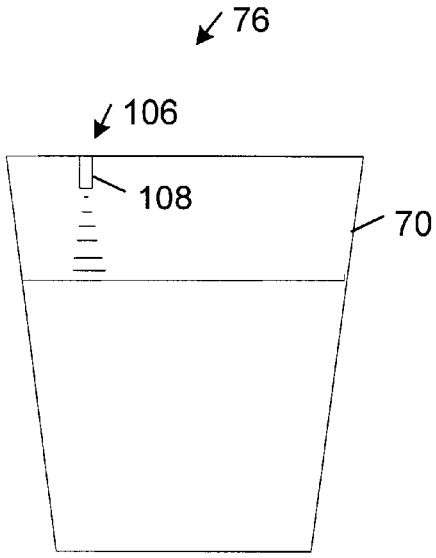
FIG. 6 is a diagrammatic side view of a marking fluid tank and an ultrasonic level sensor.

As shown in FIG. 6, in some embodiments, working level sensor 76 may be implemented in the form of a conventional ultrasonic level sensor 106, which is configured to measure the distance between the surface of the marking fluid and an ultrasonic transducer 108. In general, the ultrasonic level sensor 106 detects the change in marking fluid level based upon the length of time between the time when a burst of sonic energy is transmitted from ultrasonic transducer 108 and the time when an echo reflected from the marking fluid surface is received. The measured length of time may be converted into a distance measurement in a conventional way based upon the speed of sound in reservoir 70.

Figure 7:
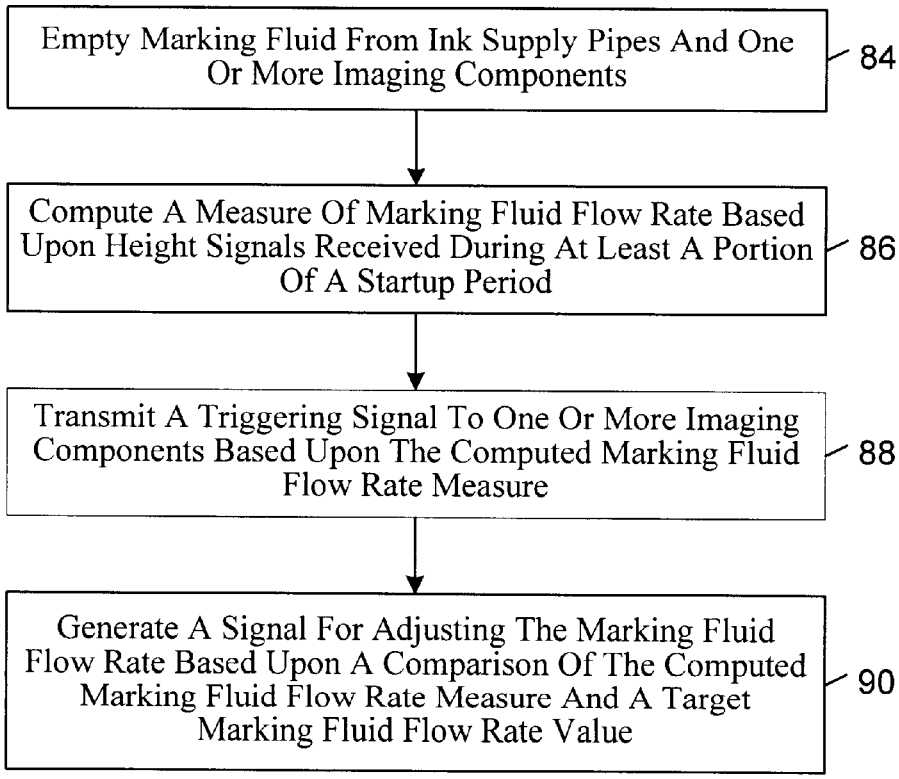
FIG. 7 is a flow diagram of a method of monitoring and controlling the flow rate of marking fluid in the imaging system of FIG. 1.
Figure 8:
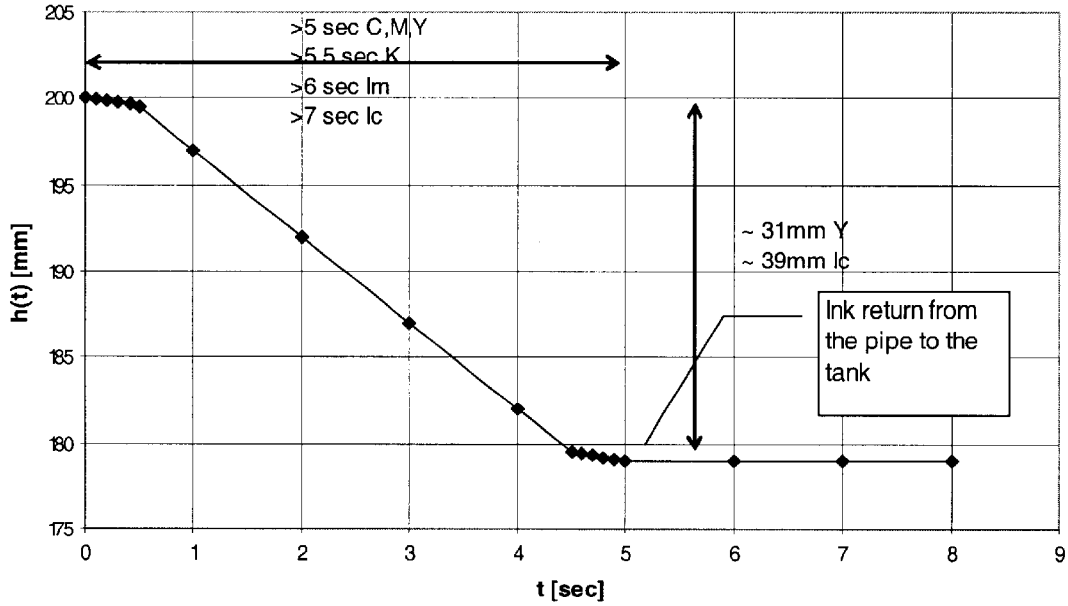
FIG. 8 is a chart of the marking fluid level measured in a marking fluid tank during a startup period of a print job.
Figure 9:
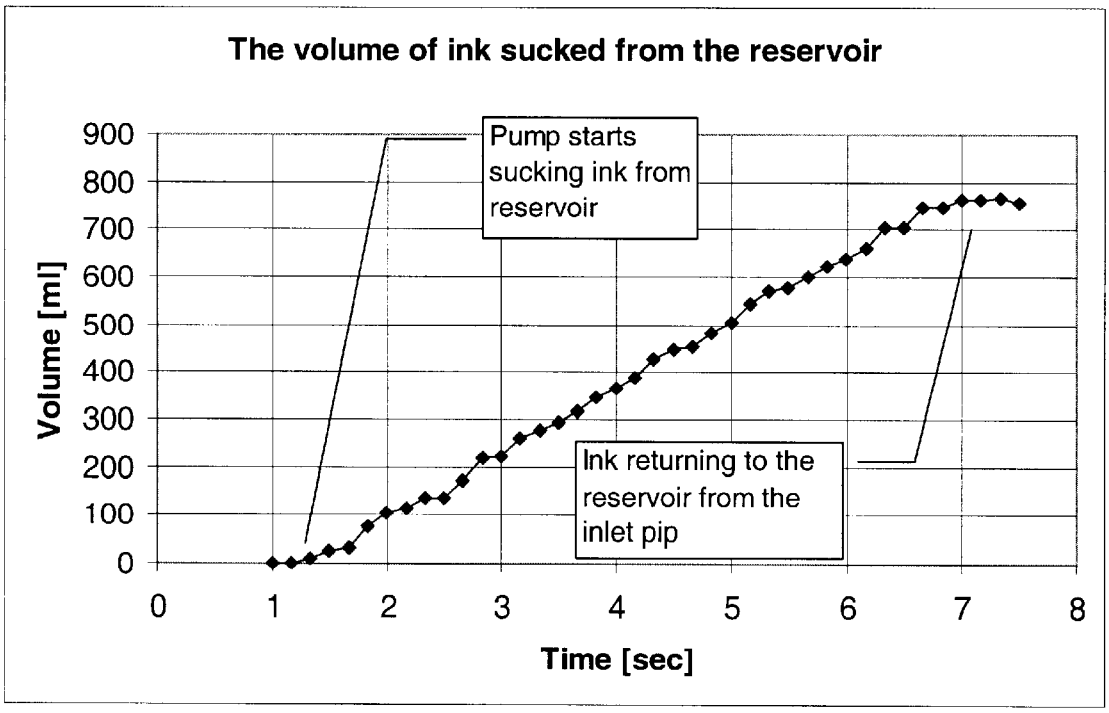
FIG. 9 is a chart of computed marking fluid volume plotted as a function of time.

Referring to FIGS. 7, 8 and 9, in one embodiment, controller 22 is operable to monitor and control the flow rate of marking fluid from marking fluid tank 18 to imaging assembly 14 as follows.

In some embodiments, controller 22 initially generates one or more control signals to empty marking fluid from the imaging assembly 14 and the marking fluid supply pipes (step 84). In this process, all of internal drums of imaging system 10 are rotated with no high voltage and no marking fluid. This process typically may be performed in about 12 seconds. In situations when the flow rate is significantly different from the target flow rate, this step may be performed between each of a sequence of flow rate measurement periods to improve the accuracy with which the flow rate is measured during each measurement period.

During at least a portion of a startup period of a new print job, controller 22 computes a measure of marking fluid flow rate based upon the height signals received from working level sensor 76 (step 86). As shown in FIG. 8, in one embodiment, working level sensor 76 generates signals indicative of the marking fluid height (h(t)) in reservoir 70 of marking fluid tank 18. The height values then may be converted into a volume measure (V(t)) in accordance with equation (1):

$$V(t)=h(t)\cdot a(h(t))$$

where a(h(t)) is the area of the marking fluid reservoir which, in general, may vary with height. In some embodiments, the ink tank is mapped to get V(h) (volume as a function of height). Since V(h) doesn't change in time, V(h) only has to be measured once at the factory. To measure the flow rate, h(t) (height as 30 a function of time) is measured every print start. Knowing V(h) we now have V(h(t)) or V(t) (volume as a function of time). Since the flow rate is constant during the h(t) measurement, V t (the volume is proportional to the time), meaning that we have a linear curve of V(t), as shown in FIG. 9. Using a regression curve fit, the curve slope dV/dt, which represents the flow rate, may be computed. As shown in FIG. 9, the volume measure (V(t)) may be computed based upon height values that are sampled multiple times during at least a portion of a startup period extending from a time when flow of marking fluid to the electrostatic imaging assembly is insubstantial to a time when marking fluid in the marking fluid tank reservoir reaches a substantially steady-state level.

Based upon this information and a predetermined computation of the volume of marking fluid required to fill the marking fluid supply pipes and the developer reservoir 50 (FIG. 2), controller 22 may compute an estimate of the time when marking fluid will reach the developer roller 42. In some electrostatic imager embodiments, controller 22 may transmit to the high voltage power supply that charges the developer roller 42 a signal that triggers the high voltage power supply at the time when the marking fluid is estimated to reach the developer roller 42 (step 88).

Controller 22 also may generate a signal for adjusting the marking fluid flow rate (step 90). This signal may be in the form of a control signal that is transmitted to flow rate controller 20 for automatically adjusting the flow rate in accordance with a preselected target flow rate. Alternatively, this signal may be in the form of instructions that describe how the flow rate controller should be adjusted manually (e.g., "rotate the flow rate control knob 30° counterclockwise"). These instructions may be displayed to a user through a graphical user interface. Controller 22 may be programmed to compute the marking fluid flow rate and to generate the flow rate adjustment signal during the startup period of every print job. Alternatively, controller 22 may be programmed to wait a preselected delay period (e.g., half of a day or after every three print jobs) before automatically computing the marking fluid flow rate and generating the flow rate adjustment signal. In some embodiments, controller 22 may be programmed to automatically compute the marking fluid flow rate and the flow rate adjustment signal during the startup period of a print job immediately following the replacement of a consumable component (e.g., marking fluid tank 18 or developer roller 42) of the electrostatic imaging system 10. In some embodiments, controller 22 may be programmed to compute the marking fluid flow rate during a startup period in response to a user input signal (e.g., a "Measure Flow Rate" or "Start" signal).

Figure 10:
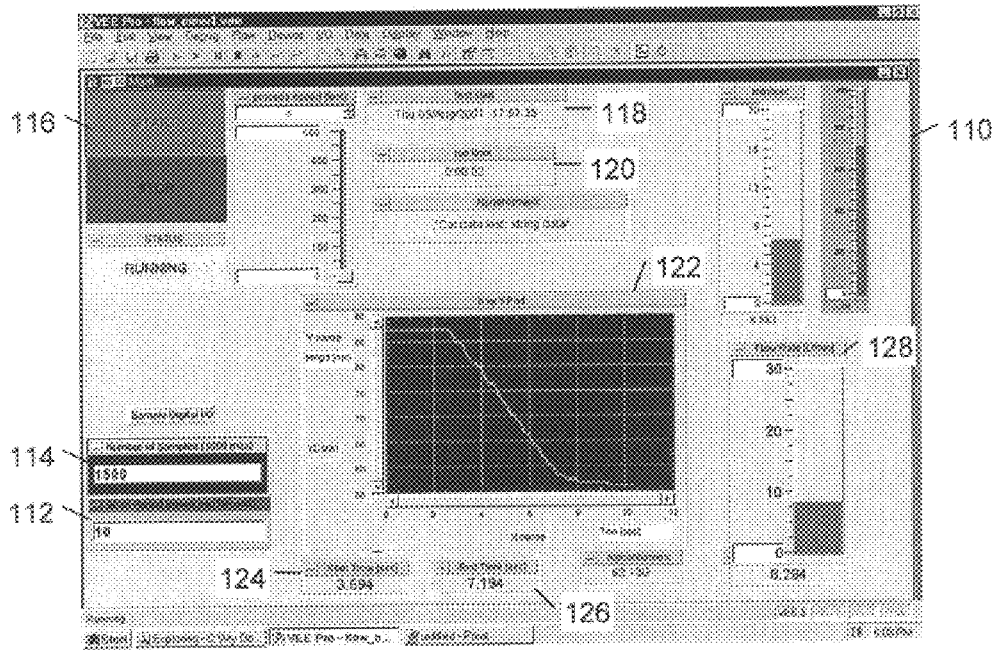
FIG. 10 is a graphical user interface through which a user may monitor and control the flow of marking fluid in the imaging system of FIG. 1.

Referring to FIG. 10, in one embodiment, a user may interact with controller 22 through a graphical user interface 110. The preset length of the scan period is displayed in a box 112 and the preset number of times that the signals generated by working level sensor 76 will be sampled is displayed in a box 114. The user may initiate a marking fluid flow rate measurement by selecting a START button 116. The measurement start date and time and the run time are displayed respectively in windows 118, 120. The sampled height signals that are generated by working level sensor 76 are displayed in a window 122 plotted as a function of time.

The start time and the time at which the fluid level in marking fluid tank 18 reaches a substantially steady-state value may be displayed in respective windows 124, 126. The marking fluid flow rate computed from the sampled height signals may be displayed numerically and graphically in a window 128.

Other embodiments are within the scope of the claims.

Figure 11:
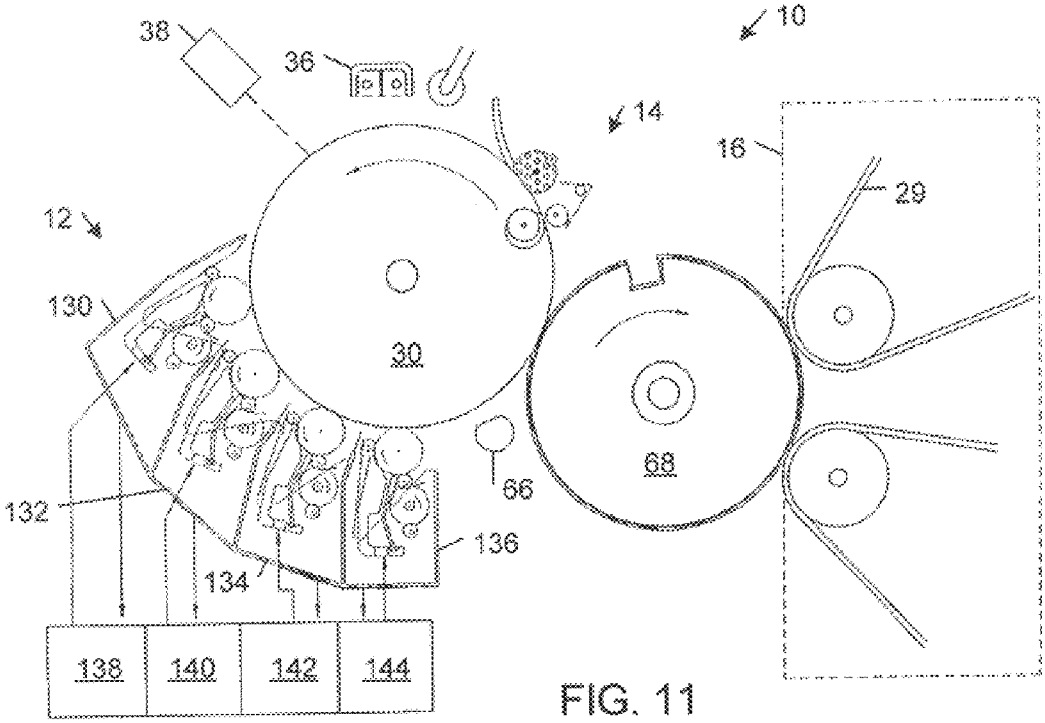
FIG. 11 is a diagrammatic side view of another electrostatic implementation of the imaging system of FIG. 1.

Although the above embodiments were described in connection with the monochromatic electrostatic imaging system implementation of FIG. 2, these embodiments also may be applied to different imaging system implementations, including multi-color electrostatic imagers and electrostatic and non-electrostatic offset imagers. For example, referring to FIG. 11, in some embodiments, imaging system 10 may be implemented as a multi-color electrostatic imager. In these embodiments, a plurality of developer assemblies 130, 132, 134, 136 each are associated with a respective marking fluid tank 138, 140, 142, 144. The developer assemblies are configured to sequentially engage the photoconductive surface 32 of drum 30 to develop sequentially produced latent images formed on photoconductive surface 32. In some of these embodiments, developer assemblies 130–136 may be combined into an integrated, multi-color development assembly. Additional details regarding the construction and operation of the electrostatic imaging system implementation of FIG. 11 may be obtained from U.S. Pat. No. 6,108,513.

The systems and methods described herein are not limited to any particular hardware or software configuration, but rather they may be implemented in any computing or processing environment, including in digital electronic circuitry or in computer hardware, firmware or software. These systems and methods may be implemented, in part, in a computer program product tangibly embodied in a machine-readable storage device for execution by a computer processor. In some embodiments, these systems and methods preferably are implemented in a high level procedural or object oriented programming language; however, the algorithms may be implemented in assembly or machine language, if desired. In any case, the programming language may be a compiled or interpreted language. The marking fluid flow rate monitoring and controlling methods described herein may be performed by a computer processor executing instructions organized, e.g., into program modules to carry out these methods by operating on input data and generating output. Suitable processors include, e.g., both general and special purpose microprocessors. Generally, a processor receives instructions and data from a read-only memory and/or a random access memory. Storage devices suitable for tangibly embodying computer program instructions include all forms of non-volatile memory, including, e.g., semiconductor memory devices, such as EPROM, EEPROM, and flash memory devices; magnetic disks such as internal hard disks and removable disks; magneto-optical disks; and CD-ROM. Any of the foregoing technologies may be supplemented by or incorporated in specially-designed ASICs (application-specific integrated circuits).

Still other embodiments are within the scope of the claims.

What is claimed is:

1. A system for supplying marking fluid in an imaging system including an assembly of one or more imaging components, comprising:

a marking fluid tank comprising a reservoir constructed and arranged to contain marking fluid;

a level sensor operable to generate height signals indicative of relative marking fluid levels in the marking fluid tank reservoir; and a controller coupled to the level sensor and operable to compute a measure of marking fluid flow rate based upon multiple height signals generated during at least a portion of a startup period extending from a time when flow of marking fluid to the imaging assembly is insubstantial to a time when marking fluid in the marking fluid tank reservoir reaches a substantially steady-state level.

2. The system of claim 1, wherein the level sensor comprises an ultrasonic level sensor.

3. The system of claim 1, wherein the level sensor comprises an optical encoder and a float carrying an optical code strip.

4. The system of claim 1, wherein the level sensor comprises one or more light emitters and one or more corresponding light detectors, and a float carrying a light-blocking member interposable between one or more light emitters and corresponding light detectors.

5. The system of claim 4, wherein the light-blocking member comprises an aperture.

6. The system of claim 1, wherein the controller is operable to generate an instruction for manually adjusting the marking fluid flow rate based upon a comparison of the computed marking fluid flow rate measure and a target marking fluid flow rate value.

7. The system of claim 1, further comprising a flow rate controller coupled between the marking fluid tank outlet and the imaging assembly, and wherein the controller is coupled to the flow rate controller and is operable to generate a control signal for automatically adjusting the flow rate controller based upon a comparison of the computed marking fluid flow rate measure and a target marking fluid flow rate value.

8. The system of claim 1, wherein the controller is operable to automatically compute the marking fluid flow rate measure during startup periods of every print job.

9. The system of claim 1, wherein the controller is operable to wait a preselected delay period after computing the marking fluid flow rate measure during a startup period of a given print job before automatically computing the marking fluid flow rate measure during a startup period of a subsequent print job.

10. The system of claim 1, wherein the controller is operable to automatically compute the marking fluid flow rate measure during a startup period of a print job immediately following replacement of a consumable component of the imaging system.

11. The system of claim 1, wherein the controller is operable to transmit a triggering signal to one or more imaging components of the assembly based upon the computed marking fluid flow rate measure.

12. The system of claim 11, wherein the controller is operable to compute a trigger time when marking fluid levels in one or more imaging components will be sufficient for activation of the one or more imaging components.

13. A method for supplying marking fluid in an imaging system including an assembly of one or more imaging components, comprising:

providing a marking fluid tank comprising a reservoir constructed and arranged to contain marking fluid;

generating height signals indicative of relative marking fluid levels in the marking fluid tank reservoir; and computing a measure of marking fluid flow rate based upon multiple height signals generated during at least a portion of a startup period extending from a time when flow of marking fluid to the imaging assembly is insubstantial to a time when marking fluid in the marking fluid tank reservoir reaches a substantially steady-state level.

14. The method of claim 13, further comprising generating an instruction for manually adjusting the marking fluid flow rate based upon a comparison of the computed marking fluid flow rate measure and a target marking fluid flow rate value.

15. The method of claim 13, further comprising generating a control signal for automatically adjusting the marking fluid flow rate based upon a comparison of the computed marking fluid flow rate measure and a target marking fluid flow rate value.

16. The method of claim 13, wherein the marking fluid flow rate measure is automatically computed during startup periods of every print job.

17. The method of claim 13, further comprising waiting a preselected delay period after computing the marking fluid flow rate measure during a startup period of a given print job before automatically computing the marking fluid flow rate measure during a startup period of a subsequent print job.

18. The method of claim 13, wherein the marking fluid flow rate measure is automatically computed during a startup period of a print job immediately following replacement of a consumable component of the imaging system.

19. The method of claim 13, further comprising transmitting a triggering signal to one or more imaging components of the assembly based upon the computed marking fluid flow rate measure.

20. The method of claim 19, further comprising computing a trigger time when marking fluid levels in one or more imaging components will be sufficient for activation of the one or more imaging components.

* * * * *